73-290 SR
1/7/86 XR 4,562,935

United States Patent [19]
Greenwood

[11] Patent Number: 4,562,935
[45] **Date of Patent: * Jan. 7, 1986**

[54] INSIDE PROTECTOR FOR BOTTOM WALL PORTION OF UNDERGROUND TANK BENEATH FILL TUBE

[75] Inventor: Mark E. Greenwood, Granville, Ohio

[73] Assignee: Owens-Corning Fiberglas Corporation, Toledo, Ohio

[ * ] Notice: The portion of the term of this patent subsequent to Jul. 20, 1999 has been disclaimed.

[21] Appl. No.: 648,618

[22] Filed: Sep. 10, 1984

Related U.S. Application Data

[63] Continuation of Ser. No. 597,584, Apr. 9, 1984, abandoned, which is a continuation of Ser. No. 352,609, Feb. 26, 1982, abandoned.

[51] Int. Cl.[4] ..... B65D 90/48; G01F 23/04
[52] U.S. Cl. ..... 220/85 R; 33/126.7 R; 73/290 R; 116/227; 220/86 R
[58] Field of Search ..... 220/85 S, 69, 85 K, 220/86 R, 85 R; 116/227; 73/320, 290 R; 145/3.7; 229/5.7; 222/382, 464, 547, 564; 141/113, 339, 374; 33/126.7 R

[56] References Cited

U.S. PATENT DOCUMENTS

| | | | |
|---|---|---|---|
| 1,265,381 | 5/1918 | Ramey | 141/339 |
| 1,846,618 | 2/1932 | Shield | 220/86 R X |
| 1,911,713 | 5/1933 | Pravda | 220/69 X |
| 2,217,578 | 10/1940 | White | 220/85 S |
| 2,294,176 | 8/1942 | Gredell | 220/86 R |
| 2,332,208 | 10/1943 | Dow | 220/69 X |
| 2,382,428 | 8/1945 | Leuvelink | 220/69 X |
| 3,016,192 | 1/1962 | Cook, Jr. et al. | 73/320 X |
| 3,464,584 | 9/1969 | McNally | 220/86 R |
| 3,487,990 | 1/1970 | Overton, III et al. | 229/5.7 X |
| 3,633,609 | 1/1972 | Benner et al. | 220/86 R X |
| 3,640,425 | 2/1972 | Auer | 220/86 R |
| 4,340,009 | 7/1982 | Greaves, Jr. | 116/227 |
| 4,399,923 | 8/1983 | Milo | 220/85 R |

*Primary Examiner*—Allan N. Shoap
*Attorney, Agent, or Firm*—Ronald C. Hudgens; Patrick P. Pacella; Paul J. Rose

[57] ABSTRACT

A cage-like protector lowerable down a fill tube of an underground tank to protect the bottom wall thereof from damage by a dropped dipstick.

5 Claims, 5 Drawing Figures

INSIDE PROTECTOR FOR BOTTOM WALL PORTION OF UNDERGROUND TANK BENEATH FILL TUBE

This is a continuation of application Ser. No. 597,584, filed on Apr. 9, 1984, abandoned, which is a continuation of application Ser. No. 352,609, filed on Feb. 26, 1982 abandoned.

TECHNICAL FIELD

This invention relates generally to underground tanks, and more particularly to a protector, for the portion of the bottom wall of an underground tank beneath the fill tube, from damage by dropped dipsticks.

BACKGROUND ART

Aluminum dipsticks are frequently used to measure the contents of underground storage tanks by insertion of a dipstick down a fill tube, retraction, and observation of the position of the boundary between wet and dry portions of the dipstick. Comparison of daily readings with the metered pumpage gives an indication of the presence of leaks. Careless operators may drop a dipstick down a fill tube and damage the bottom wall of the tank. For tanks made of glass fiber reinforced plastic, prior attempts to prevent damage from dipsticks have included installing steel plates at the bottom of the tank beneath the fill tube, or pouring rubberized epoxy resin down the fill tube.

Because contractors frequently install the fill tube in other than the intended fitting, some companies order metal plates under all fittings at the time an order is placed for a tank. The different plate specifications render it difficult to maintain a line of standard tanks.

DISCLOSURE OF THE INVENTION

In accordance with the invention, an inside protector insertable down a fill tube of an underground tank has been provided. The protector comes to rest on the bottom wall portion of the tank while its upper end portion is retained in the lower end portion of the fill tube. The protector includes a circular lower steel plate, a plurality of steel rods, and an upper ring. A circular resilient pad is attached to the bottom surface of the lower plate. The lower ends of the rods are recessed in the lower plate, and the upper ends are secured to the inner periphery of the upper ring.

BRIEF DESCRIPTION OF DRAWINGS

The invention is described more particularly hereinafter with reference to the accompanying drawings in which.

BEST MODE OF CARRYING OUT THE INVENTION

Figure 1:
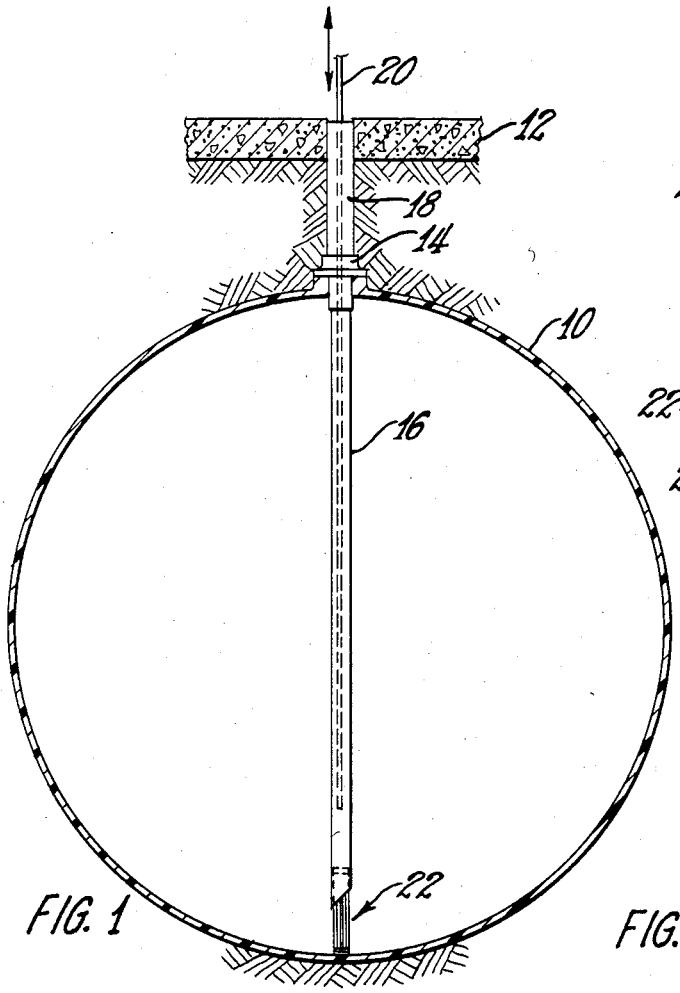
FIG. 1 is a cross-sectional elevational view of an underground tank having an inside protector constructed in accordance with the invention disposed on the bottom wall thereof beneath the fill tube.

With reference to the drawings, FIG. 1 illustrates an underground storage tank 10 made of glass fiber reinforced plastic and mounted beneath a concrete slab 12. The tank 10 includes a fitting 14 disposed in an upper wall portion thereof. The fitting 14 has an inner fill tube 16 secured in a lower end portion thereof and an outer fill tube 18 secured in an upper end portion thereof. The upper end of the outer fill tube 18 is secured in the concrete slab 12. A portion of a dipstick 20 is shown extending downwardly through the outer fill tube 18 and the fitting 14 and most of the way through the inner fill tube 16. The lower end portion of the inner fill tube 16 is spaced from the bottom wall portion of the tank.

Figure 3:
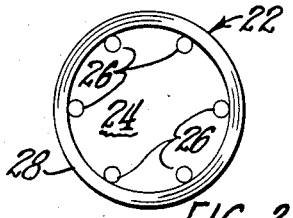
FIG. 3 is a top plan view of the protector taken from the top of FIG. 2.
Figure 2:
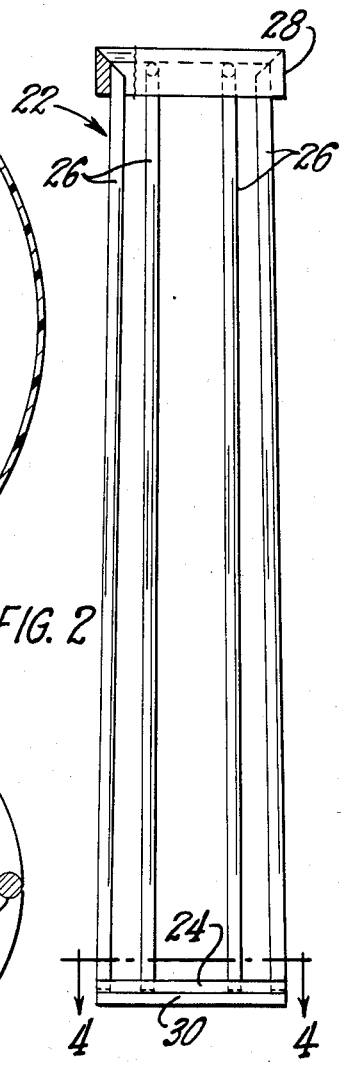
FIG. 2 is an elevational view of the protector, enlarged from the scale of FIG. 1.

An inside protector 22 constructed in accordance with the invention has been lowered down the tubes 16 and 18 in FIG. 1 to assume a position of rest on the bottom wall of the tank 10 where it will protect the bottom wall against damage by a dropped dipstick 20. As shown in FIGS. 2 and 3, the protector 22 includes a lower circular steel plate 24, a plurality of steel rods 26 preferably of circular cross section, an upper steel ring 28, and a resilient pad 30. In the embodiment shown, the upper ends of the rods 26 are welded to the inner periphery of the ring 28 and the end surfaces are angled at about forty-five degrees to match a corresponding downwardly convergent chamfer provided on the upper surface of the ring 28. Alternatively, the rods 26 may be welded to the ring 28 in any other suitable manner, such as having end surfaces parallel and butt-welded to a lower surface of the ring, or having end portions welded within recesses in the lower surface of the ring.

Figure 4:
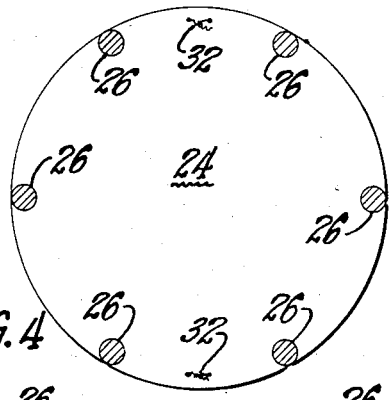
FIG. 4 is an enlarged horizontal cross-sectional view of the protector taken along the line 4—4 of FIG. 3.
Figure 5:
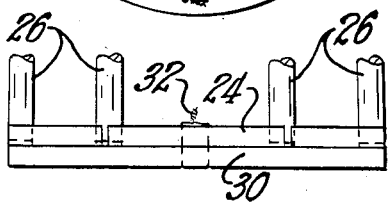
FIG. 5 is a fragmentary elevational view of the protector taken from the front of FIG. 4.

As best shown in FIGS. 4 and 5, the plate 24 is provided adjacent its periphery with a plurality of equally arcuately spaced holes in which the lower end portions of the rods 26 are respectively received and welded in place. The resilient pad 30 is secured to the lower surface of the plate 24 by a pair of generally U-shaped wires 32, similar to staples, extending through suitable holes in the pad 30 and the plate 24 and respectively having their end portions twisted together at the upper surface of the plate 24. The pad 30 and the plate 24 are each about one-fourth of an inch thick. The pad 30 is preferably made of a chemically resistant synthetic rubber such as Viton, available from E. I. du Pont de Nemours & Co., Inc.

With the protector 22 in position, a dropped dipstick 20 will hit the plate 24, and the resilient pad 30 will cushion the shock to the bottom wall portion of the tank 10.

Various modifications may be made in the structure shown and described without departing from the spirit and scope of the invention.

I claim:

1. For use with a cylindrical underground storage tank having an opening in an upper wall portion thereof and having an inner fill tube communicating with the opening, extending downwardly therefrom, and ending closely adjacent to but in spaced relationship from a bottom wall of the tank, an inside protector for the portion of the bottom wall beneath the fill tube, the protector comprising a generally circular bottom plate, a resilient pad secured to the lower surface of the plate, a plurality of arcuately spaced rods having lower ends portions secured to the plate, and an upper ring secured to upper end portions of the rods, the protector being adapted to be lowered down the fill tube to a position wherein the resilient pad is in contact with the bottom wall of the tank and the upper ring is retained within the fill tube, whereby a dipstick dropped down the fill tube strikes said circular bottom plate rather than impinging directly on the bottom wall of the tank.

2. A protector as claimed in claim 1 wherein the rods, the upper ring, and the lower plate are made of steel.

3. A protector as claimed in claim 2 wherein the upper end portions of the rods are welded to the inner periphery of the upper ring.

4. A protector as claimed in claim 3 wherein the upper surface of the ring is provided with a downwardly convergent chamfer and the upper end surfaces of the rods are correspondingly angled as continuations of the chamfer on the ring.

5. A protector as claimed in claim 2 wherein the lower plate is provided adjacent its periphery with a plurality of arcuately spaced holes extending therethrough and the lower end portions of the rods are received respectively in the holes in the plate and welded in place.

* * * * *